US008119954B2

(12) United States Patent
Vissa et al.

(10) Patent No.: US 8,119,954 B2
(45) Date of Patent: Feb. 21, 2012

(54) CONVECTIVE HEATING SYSTEM FOR INDUSTRIAL APPLICATIONS

(75) Inventors: Ramgopal Vissa, Hyderabad (IN); Ganta S. Reddy, Cincinnati, OH (US); Jainagesh A. Sekhar, Cincinnati, OH (US)

(73) Assignee: Micropyretics Heaters International, Inc., Cincinnati, OH (US)

( * ) Notice: Subject to any disclaimer, the term of this patent is extended or adjusted under 35 U.S.C. 154(b) by 1270 days.

(21) Appl. No.: 11/682,107

(22) Filed: Mar. 5, 2007

(65) Prior Publication Data

US 2007/0145038 A1 Jun. 28, 2007

Related U.S. Application Data

(63) Continuation-in-part of application No. 10/703,497, filed on Nov. 10, 2003, now abandoned.

(60) Provisional application No. 60/438,321, filed on Jan. 7, 2003, provisional application No. 60/832,608, filed on Jul. 24, 2006.

(51) Int. Cl.
*H05B 3/58* (2006.01)
*F24H 3/02* (2006.01)

(52) U.S. Cl. ..... 219/535; 392/379

(58) Field of Classification Search ..... 219/535–541; 392/379, 485–489

See application file for complete search history.

(56) References Cited

U.S. PATENT DOCUMENTS

| | | | | |
|---|---|---|---|---|
| 1,376,485 A | | 5/1921 | Verstraete | |
| 1,820,842 A | * | 8/1931 | Sparks | 219/536 |
| 2,467,393 A | * | 4/1949 | Leher | 392/401 |
| 3,004,540 A | * | 10/1961 | Ronzi | 132/212 |

(Continued)

FOREIGN PATENT DOCUMENTS

DE 69660 3/1906

(Continued)

OTHER PUBLICATIONS

Carlos Novoa; Invitation to Pay Additional Fees and Partial International Search Report in related International application No. PCT/US2007/084670; dated as mailed on Apr. 28, 2008; 10 pages; European Patent Office.

(Continued)

*Primary Examiner* — Sang Paik

(57) ABSTRACT

A coil-in-coil electric heating assembly for industrial applications heats any gas through an annular space between the coils to very high temperatures. Gas is introduced into the annular space through one open end of a tubular enclosure and leaves through an opposite end after being significantly heated. Coils may be made from several heating element materials and may be wound in the same direction or opposite direction. The opposite winding direction often gives a higher temperature of the exit gas. Temperatures even as high as 1500° C. in the exit gas have been recorded. The heating system may be utilized to generate superheated steam for industrial applications even in a recirculating manner.

30 Claims, 9 Drawing Sheets

U.S. PATENT DOCUMENTS

| | | | | | |
|---|---|---|---|---|---|
| 3,094,606 | A | * | 6/1963 | Ferris | 219/228 |
| 3,258,578 | A | * | 6/1966 | Ferris | 392/404 |
| 3,512,114 | A | * | 5/1970 | Dzaack | 338/241 |
| 3,760,315 | A | | 9/1973 | Hartmann | |
| 3,816,706 | A | | 6/1974 | Meywald | |
| 4,114,022 | A | * | 9/1978 | Braulke, III | 392/383 |
| 4,149,104 | A | | 4/1979 | Yoshimori | |
| 4,350,872 | A | | 9/1982 | Meywald et al. | |
| 4,794,225 | A | | 12/1988 | Maese | |
| 5,134,684 | A | * | 7/1992 | Mishou et al. | 392/486 |
| 5,426,351 | A | | 6/1995 | Imura | |
| 5,655,212 | A | | 8/1997 | Sekhar et al. | |
| 5,766,458 | A | | 6/1998 | Sekhar et al. | |
| 5,841,943 | A | | 11/1998 | Nosenchuck | |
| 5,963,709 | A | | 10/1999 | Staples et al. | |
| 6,013,903 | A | | 1/2000 | Mifune et al. | |
| 6,456,785 | B1 | * | 9/2002 | Evans | 392/488 |
| 2004/0134480 | A1 | | 7/2004 | Vissa et al. | |

FOREIGN PATENT DOCUMENTS

| | | |
|---|---|---|
| DE | 3322077 | 1/1985 |
| GB | 190007617 | 3/1901 |
| GB | 703662 | 2/1954 |
| WO | 2006101467 | 9/2006 |

OTHER PUBLICATIONS

M. Fu, Kandy Staples and Vijay Sarvepalli, A High Capacity Melt Furnace for Reduced Energy Consumption and Enhanced Performance, Journal of Metals (JOM), May 1998, pp. 42-44.

Advance Materials & Processes, Magazine, pp. 213-215, Oct. 1999.

Vagn Nissen; International Search Report and Written Opinion; Apr. 16, 2008; 18 pages; European Patent Office.

* cited by examiner

CONVECTIVE HEATING SYSTEM FOR INDUSTRIAL APPLICATIONS

This is a continuation-in-part of U.S. patent application Ser. No. 10/703,497, filed Nov. 10, 2003 which claimed the benefit of U.S. Provisional Patent Application Ser. No. 60/438,321 filed Jan. 7, 2003, each of which is hereby incorporated by reference in its entirety. This also claims the benefit of U.S. Provisional Patent Application Ser. No. 60/832,608, filed Jul. 24, 2006 and also hereby incorporated by reference in its entirety.

BACKGROUND OF THE INVENTION

Heating of gases can be carried out by a variety of techniques including conduction, radiation and convection. A wide variety of thermal processing applications are found throughout industry including materials processing and chemical applications. The industrial process of heat-treating, joining, curing and drying are carried out in many different types of systems, furnaces and ovens. The heating method of choice for such applications is normally a radiative technique with radiant electric heating elements placed along the walls of the furnace. Although such a method is efficient for very high temperature applications, the use of convection as the heat transfer mechanism often proves to be efficient in the lower temperature ranges. The following prior art patents all pertain to various methods of heating gases; namely, U.S. Pat. Nos. 5,766,458; 5,655,212 and 5,963,709. Discussions on convective heating are available from (1) M. Fu, Kandy Staples and Vijay Sarvepalli. A High Capacity Melt Furnace for Reduced Energy Consumption and Enhanced Performance. Journal of Metals (JOM), May 1998, pg 42 and (2) *ADVANCE MATERIALS & PROCESSES* magazine (pages 213 to 215, October, 1999).

The proper selection of thermal heating for industrial applications such as processing ovens and furnaces is a critical decision to meet the needs of almost all engineering products during their manufacture. The considerations of heating devices and techniques are much different for such industrial applications compared to residential or consumer applications such as hair dryers, hot air popcorn poppers and the like, examples of which are disclosed in U.S. Pat. Nos. 4,350,872; 4,794,255 and 4,149,104. The differences are largely due to the vastly divergent temperature, pressure and airflow requirements. Oven and furnace design for industrial applications must take into consideration heat transfer methods, the temperature uniformity, movement of the product, atmosphere, construction and the heat generation method. Heat processing equipment is usually classified as ovens operating to 1000° C. and as furnaces above this temperature. Batch and continuous designs are the common choices depending on the flexibility and productivity requirements. The source of heat is normally provided by oil, gas or electricity.

Gas heating techniques include convection, forced convection and radiation. Natural convection is slow and not very uniform. Forced convection on the other hand is easily controllable and can be directed for odd shapes. Radiant heat transfer at higher temperatures may be faster for some products, but may contribute other problems to the process like non-uniformity and distortion, to mention a few. Forced convection offers advantages over radiant heating for a number of industrial applications. Forced hot convection is also used for fuel cells, automobile test beds and product qualifications.

SUMMARY OF THE INVENTION

These and other problems in the prior art have been addressed by this invention which, in one embodiment, is an industrial gas heater having a tubular enclosure with a gas entry port spaced from a gas exit port. The industrial gas heater, in various embodiments, includes an inner helical coil contained within the tubular enclosure and an outer helical coil also contained within the tubular enclosure and surrounding the inner coil to define a substantially unobstructed annular space between the coils. Each coil is electrically heated to convectively heat a gas entering the tubular enclosure via the gas entry port, passing through the annular space between the coils and exiting the tubular enclosure via the gas exit port.

In various other embodiments according to this invention, the inner and outer coils are each right circular helical coils and are arranged concentrically. The inner and outer coils may be wound in opposite directions from each other or in the same direction. The individual coils may be formed from a generally continuous wire concentrically wound into a right circular helical coil. In other embodiments of this invention, the inner and outer coils may have different configurations from one another. A spacer may be positioned within the tubular enclosure and proximate the gas exit port and adjacent distal ends of the inner and outer coils to minimize deformation of the coils.

The tubular enclosure may be a housing in the form of a right circular cylinder having an open end proximate the gas entry port and an end cap closes the open end of the housing. In various embodiments of this invention, the outer coil is positioned in close proximity to or in contact with an inner surface of the tubular enclosure to minimize gas flow between the outer coil and the inner surface of the tubular enclosure and to maximize heat transfer to the gas.

Since the present invention is intended for industrial applications, the inner and outer coils are adapted to heat the gas flowing through the annular space and exiting the gas exit port to a temperature in the range of 500° C. to about 1500° C. and at a rate in the range of about 1 cubic foot per minute (CFM) to about 1000 CFM.

In another embodiment of this invention, multiple of the industrial gas heaters are arranged and mounted in a sealed gas flow chamber. In a further modification, each of the wires utilized for the coils in the gas heaters are themselves configured as coils. Moreover, the industrial gas heater of this invention may be utilized to generate super-saturated steam.

This invention also includes a method for heating a gas for industrial applications including the steps of introducing the gas into a tubular enclosure through an entry port and then flowing the gas through a substantially unobstructed annular space within the tubular enclosure and between inner and outer helical coils. The helical coils are electrically heated to heat the gas flowing there through. The gas is then expelled out of the tubular enclosure through an exit port at a temperature in the range of 500° C. to about 1500° C. and at a rate in the range of about 1 CFM to about 1000 CFM. In various other embodiments of this method, the gas is rifled or spiraled between adjacent turns of the inner and outer coils to increase the heat transfer to the gas. The inner and outer coils may be oppositely wound from one another so that the gas spiraling between the adjacent turns of the inner coil is in the direction opposite the gas spiraling between the adjacent turns of the outer coil to thereby increase the heat transfer to the gas.

As a result, a convective heating system and associated method for heating a gas for industrial applications are provided that overcome many of the shortcomings associated with known systems and techniques in the prior art.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

DETAILED DESCRIPTION OF THE INVENTION

This invention provides a new technique for very low cost convective heat generation. One aspect of the invention is to heat the air or gas through a concentric energized heating coil system. We have found that the concentric design heats the gas to a more consistent temperature in an energy efficient manner.

Figure 1:
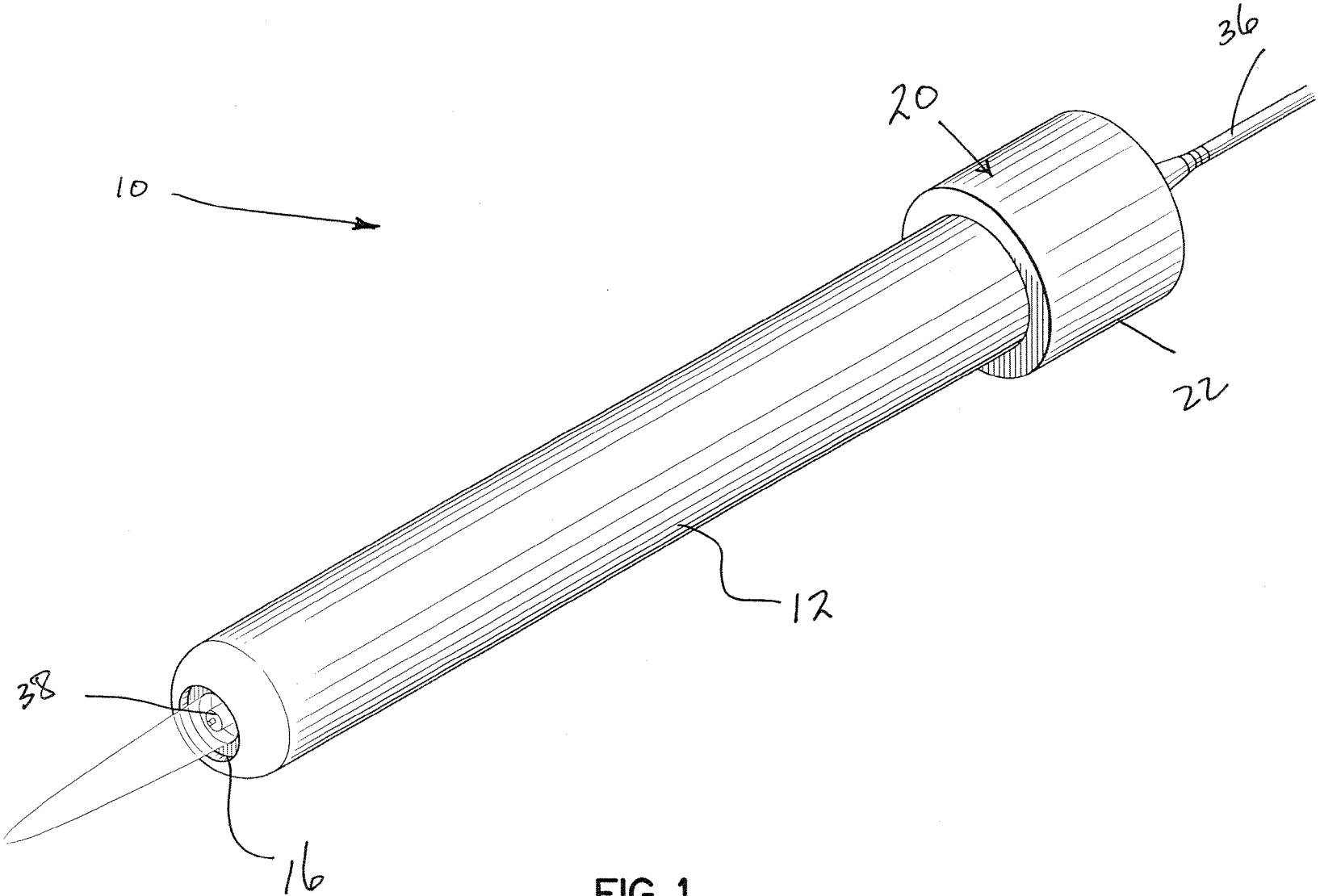
FIG. 1 is a perspective view of an exemplary embodiment of an industrial heating system according to this invention.
Figure 2:
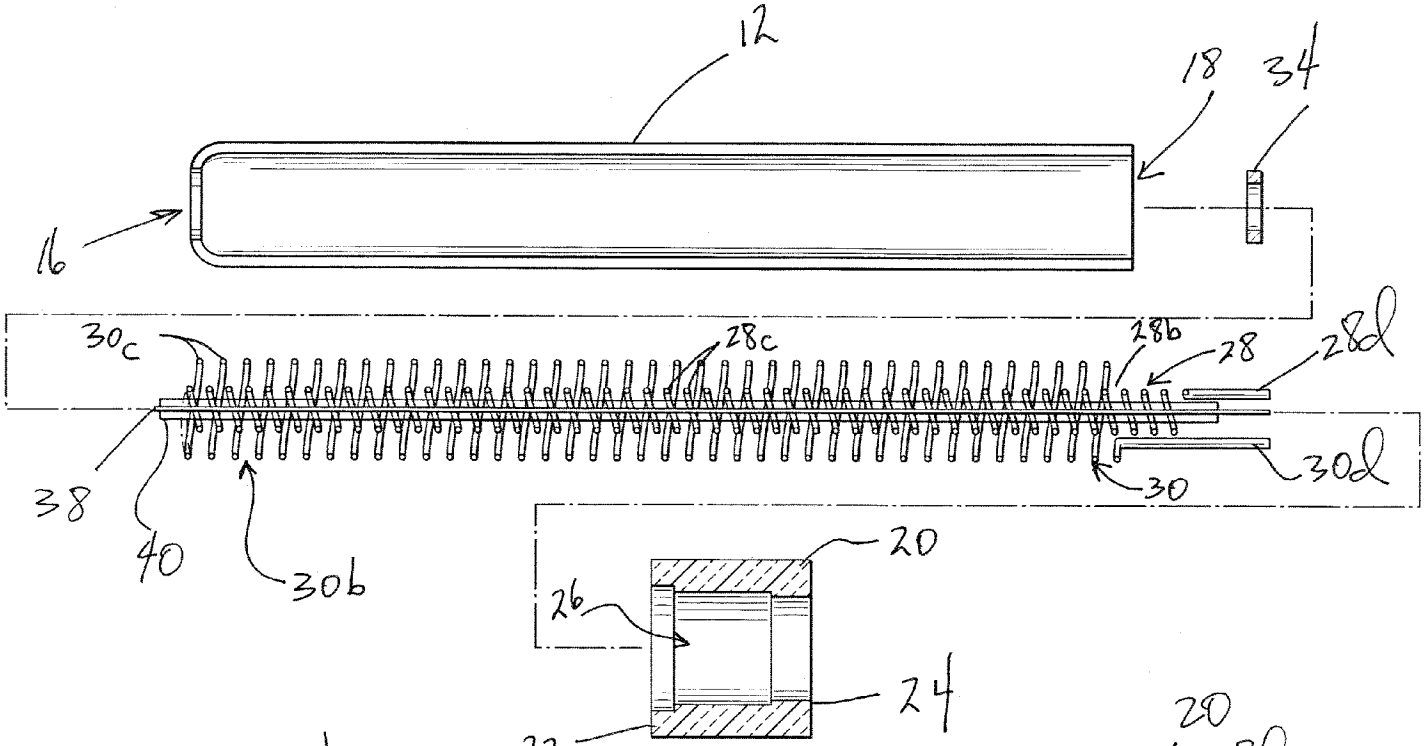
FIG. 2 is a disassembled side elevational view of the heating system of FIG. 1.
Figure 3:
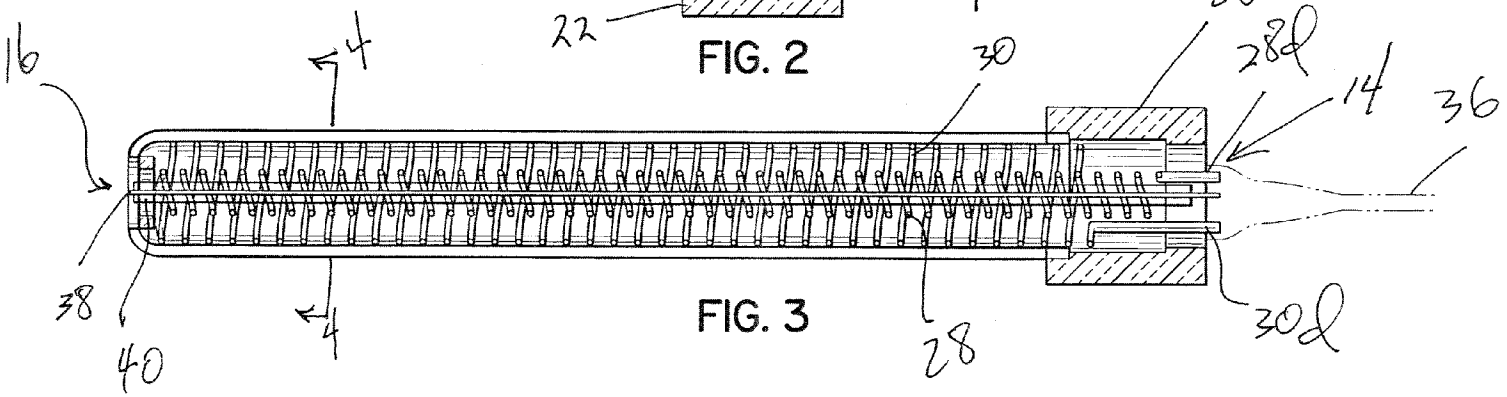
FIG. 3 is an assembled side elevational view of the heating system of FIG. 2.

Referring to FIGS. 1-3, an exemplary embodiment of an industrial gas heater 10 according to this invention is shown. The heater 10 includes a generally right circular cylindrical tubular housing 12 having a gas entry port 14 at a first end of the housing 12 spaced from a gas exit port 16 at an opposite end of the housing 14. The housing 14 may be a monolithic ceramic tube or other material such as a metallic enclosure. However, we have found that the temperature of the gas heated within the assembly is increased anywhere from 25-200° C. when a ceramic housing is utilized.

The gas entry port 14 is proximate an open end 18 of the housing 14 and is selectively closed by an end cap 20 mounted on the open end 18 of the housing 14. The end cap 20 may be made from a ceramic of approximately 90 percent aluminum oxide. The cap 20 includes an annular sidewall 22 and an end wall 24. The end cap 20 is a partially open end cap and according to various embodiments of this invention, the end cap 20 can be fully or partially open with additional openings for electrical feed-throughs and thermocouple feed-throughs. A stepped passage 26 is formed on the interior of the sidewall 22 and the gas entry port 14 is on the end wall 24. The opening diameter of the gas entry port 14 to the gas exit port 16 may be at a ratio of about 2:1.

The gas heater 10 includes an inner helical coil 28 and an outer helical coil 30 contained within the tubular housing 12. The inner and outer coils 28, 30 are coaxially aligned and concentrically arranged as right circular helical coils within the housing 12 to define a substantially unobstructed annular space 32 for passage of gas through the housing 12 from the entry port 14 to the exit port 16. In one embodiment, each coil 28, 30 is formed from a generally continuous wire 28*a*, 30*a*, respectively, concentrically wound into right circular helical coils. The wires 28*a*, 30*a* have cross sections 28*f*, 30*f* respectively which indicate a solid, unsheathed and bare composition for wires 28*a* and 30*a*. In this embodiment the wires 28*a* and 30*a* have no coating, insulation, cladding or sheathing of any kind, but are solid pieces of uniform material across their diameters. A diameter of the wire 28*a*, 30*a* for each coil may range from about 0.1 mm to about 6 mm. A gap 28*b*, 30*b* between the adjacent turns 28*c*, 30*c* of each coil 28, 30 may 8 range from about 0.01 mm to about 85 mm. The gap or pitch of each coil 28, 30 may increase adjacent to the entry port 14 and terminal lead wires 28*d*, 30*d*.

Figure 10:
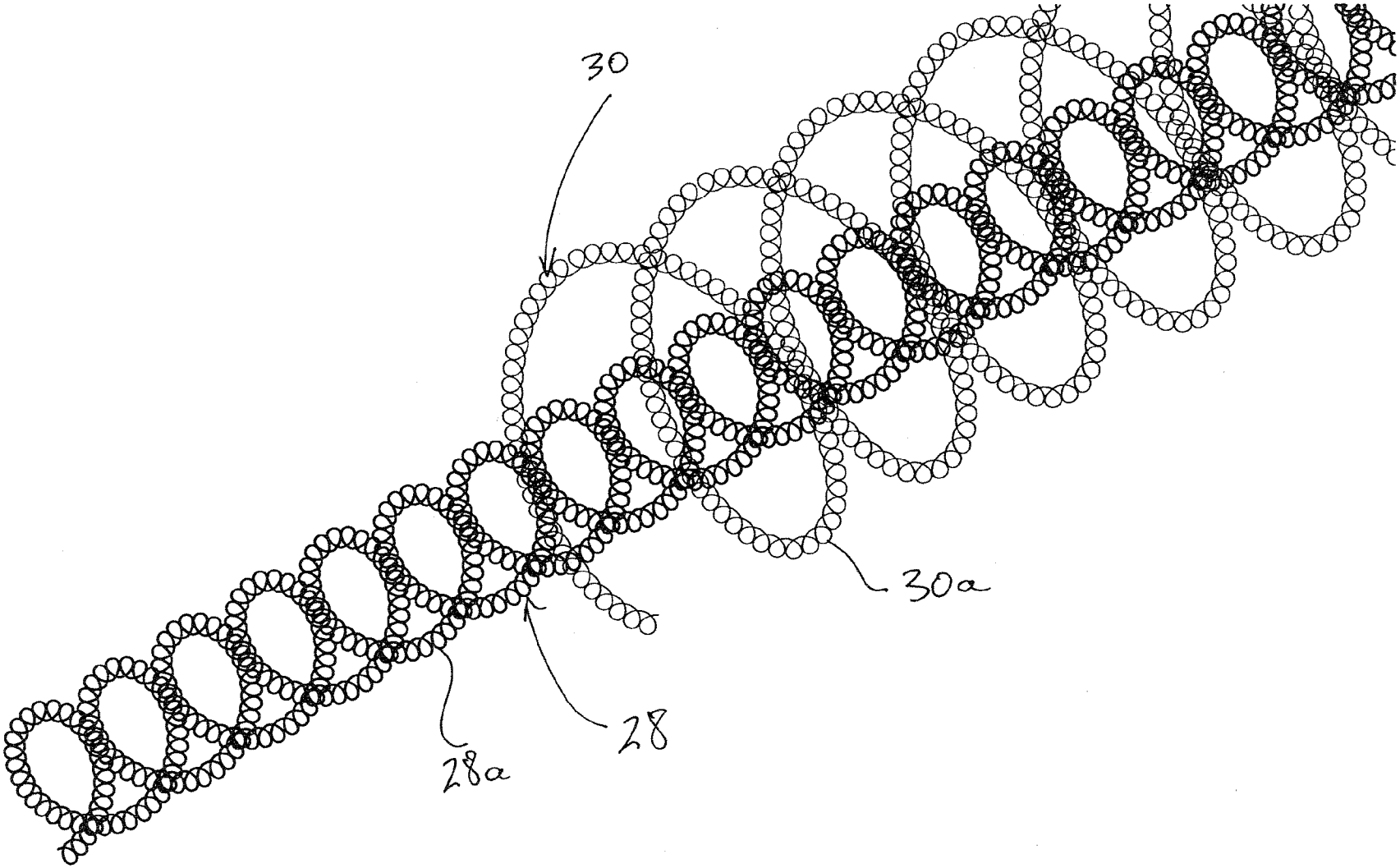
FIG. 10 is a perspective view of an alternative embodiment of heating coils to be utilized in an industrial heating system according to this invention.

In a further embodiment as shown in FIG. 10, the wires 28*b*, 30*b* of either or both of the coils 28, 30 are themselves right circular helical coils to increase the heat transfer from the coils 28, 30 to the gas. The diameter of the coiled-coil configuration of FIG. 1*o* may range from about 0.5 mm to about 10 mm.

We have found that where the outer coil 30 is in close proximity to and/or in contact with the inside face of the tubular housing 12, the gas processed in the heater lo is heated approximately 25° to 200° C. higher than if the outer coil 30 is not in such a configuration relative to the housing 12. Additionally, a spacer 34 which may be ceramic is positioned at the distal end of the coils 28, 30 proximate the gas exit port 16. The spacer 34 increases the useful life of the coils 28, 30 and minimizes coil deformation over extended periods of use.

Figure 4:
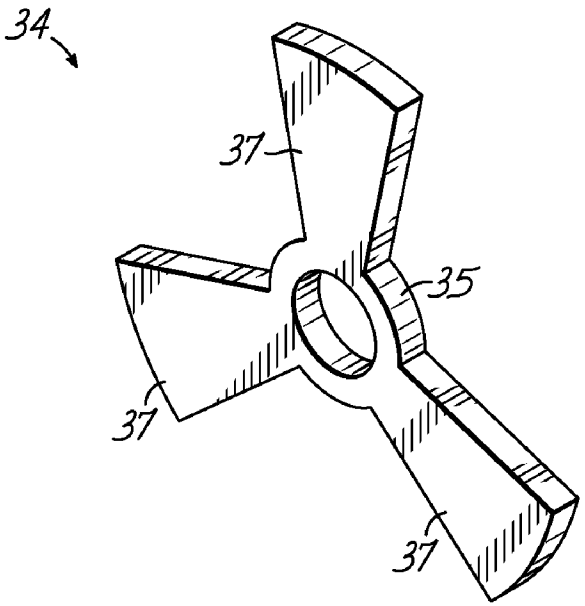
FIG. 4 is an enlarged perspective view of a spacer utilized in the heating systems of FIG. 1.

One embodiment of the spacer 34 is shown in FIG. 4 and includes a central, annular circular ring 35 that is adapted to be mounted on a central rod 40. The rod 40 may be ceramic or another material. The spacer 34 has a number, three of which are shown in FIG. 4, vanes 37 radiating outwardly from the ring 35. The vanes 37 are equally spaced around the circumference of the ring 35 and each have an outwardly tapered or flared configuration.

Terminal lead wires 28*d*, 30*d* extend from the proximal end of the respective coils 28, 30 and through the end wall 24 of the end cap 20 to be electrically coupled to a power cord 36 and a power source (not shown) for heating the coils 28, 30. Any power requirement may be appropriate for the coils 28, 30, but typically 110-volt (approximately 1 kilowatt) modules are utilized.

A thermocouple lead 38 is positioned coaxially and longitudinally within the coils 28, 30 for reading the gas temperature adjacent the gas exit port 16. The thermocouple 38 is mounted on the central rod 40 positioned coaxially relative to the inner and outer coils 28, 30 in the housing 12. The arrangement and juxtaposition of the coils, thermocouple, central rod and housing are among the features of the present invention that provide for a very compact, space-saving design for the gas heater.

Figure 5:
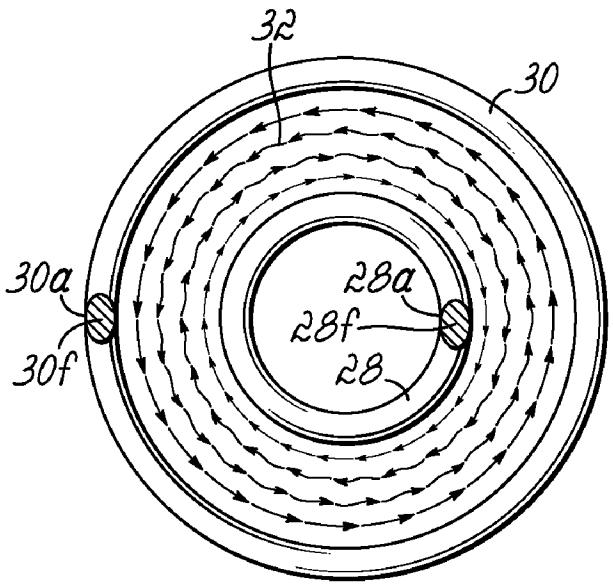
FIG. 5 is a cross-sectional view showing an annular space between inner and outer heating coils and the bare and uniform wires comprising the coils of the system of FIGS. 1-3.
Figure 6:
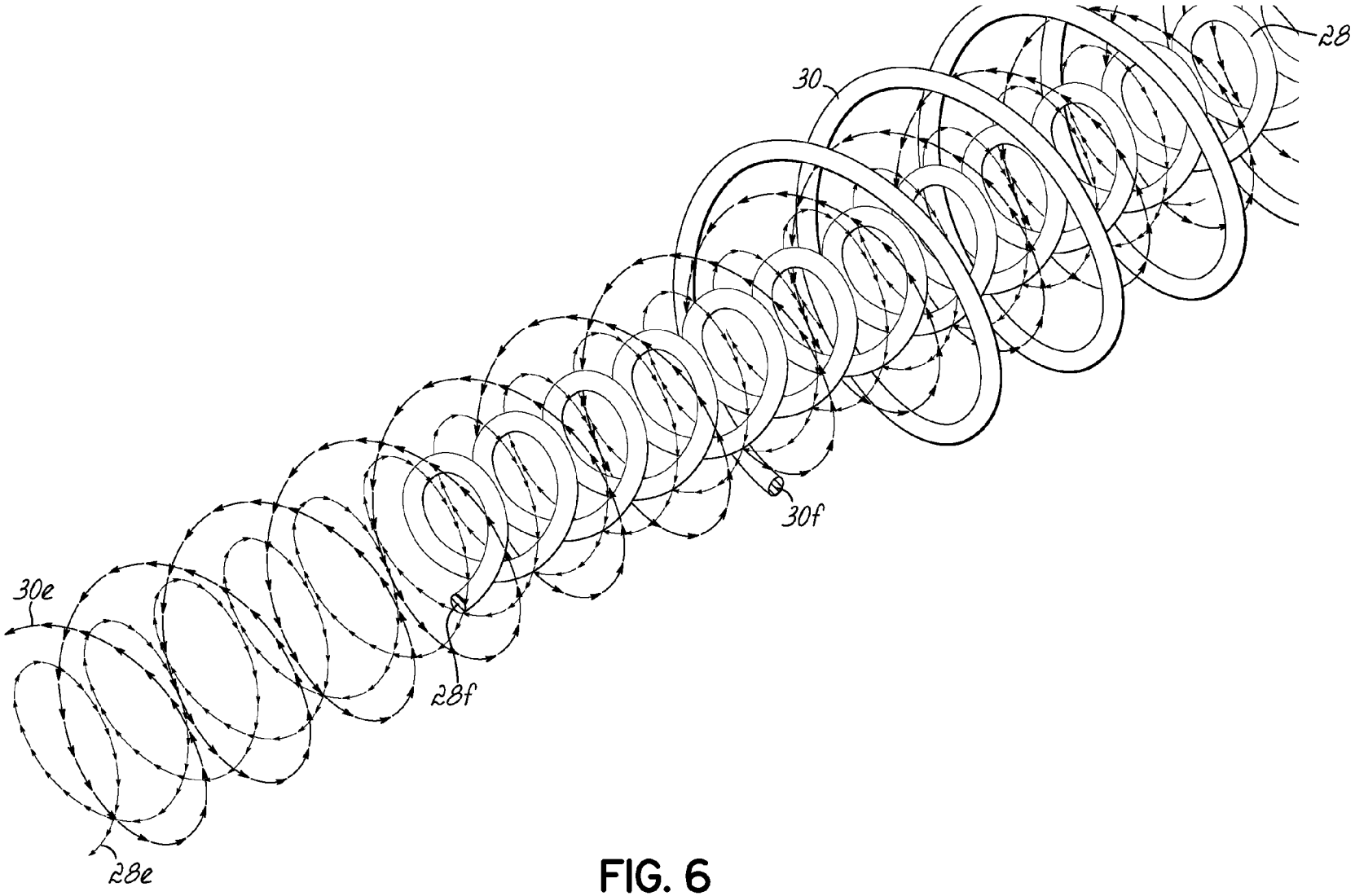
FIG. 6 is a perspective schematic view of the rifling airflow through the inner and outer heating coils as well as a cross sectional view of the bare and uniform composition of the wires comprising the inner and outer coils.

Among the advantages provided by a gas heater 10 according to this invention is the increased contact between the gas flowing from the entry port 14 to the exit port 16 with the coils 28, 30. For example, the coils 28, 30 may be similarly wound or wound in opposite directions as shown in FIG. 6. Gas flowing through the housing 12 passes through the annular space 32 between the coils 28, 30 as shown in FIG. 5. The annular space 32 and flow path of the gas in this area is generally unobstructed to provide for appropriate thermal exchange from the coils 28, 30 to the gas. Additionally, gas flowing between the adjacent turns 28*c*, 30*c* of the respective coils 28, 30 flows in a riffling or spiraling configuration as schematically shown in FIG. 6 with flow paths 28*e*, 30*e*. With the windings of the respective coils 28, 30 being in opposite direction, increased mixing of the gas with the coils 28, 30 is provided to obtain a more turbulent gas flow. The thermal exchange may be further enhanced with the coil 28, 30 configuration shown in FIG. 10. Each of these arrangements provides for increased thermal transfer from the heated coils 28, 30 to the gas relative to prior art industrial gas heating systems.

Radial dimensions of the annular spacing 32 (FIG. 5) may range from about 1.5 mm to about 20 mm with a presently preferred annular spacing 32 being about 2 mm. The range of gap spacing between the adjacent turns 28*c*, 30*c* of the wires 28*a*, 30*a* in the coils 28, 30 is between about 35 mm and about 85 mm with the presently preferred being about 40 mm for the inner coil 28 and about 65 mm for the outer coil 30. The cross sectional area of the annular spacing 32 ranges between about 15 $mm^2$ to about 6000 $mm^2$ with the presently preferred being derived from the above-identified gap spacing ranges.

Figure 8:
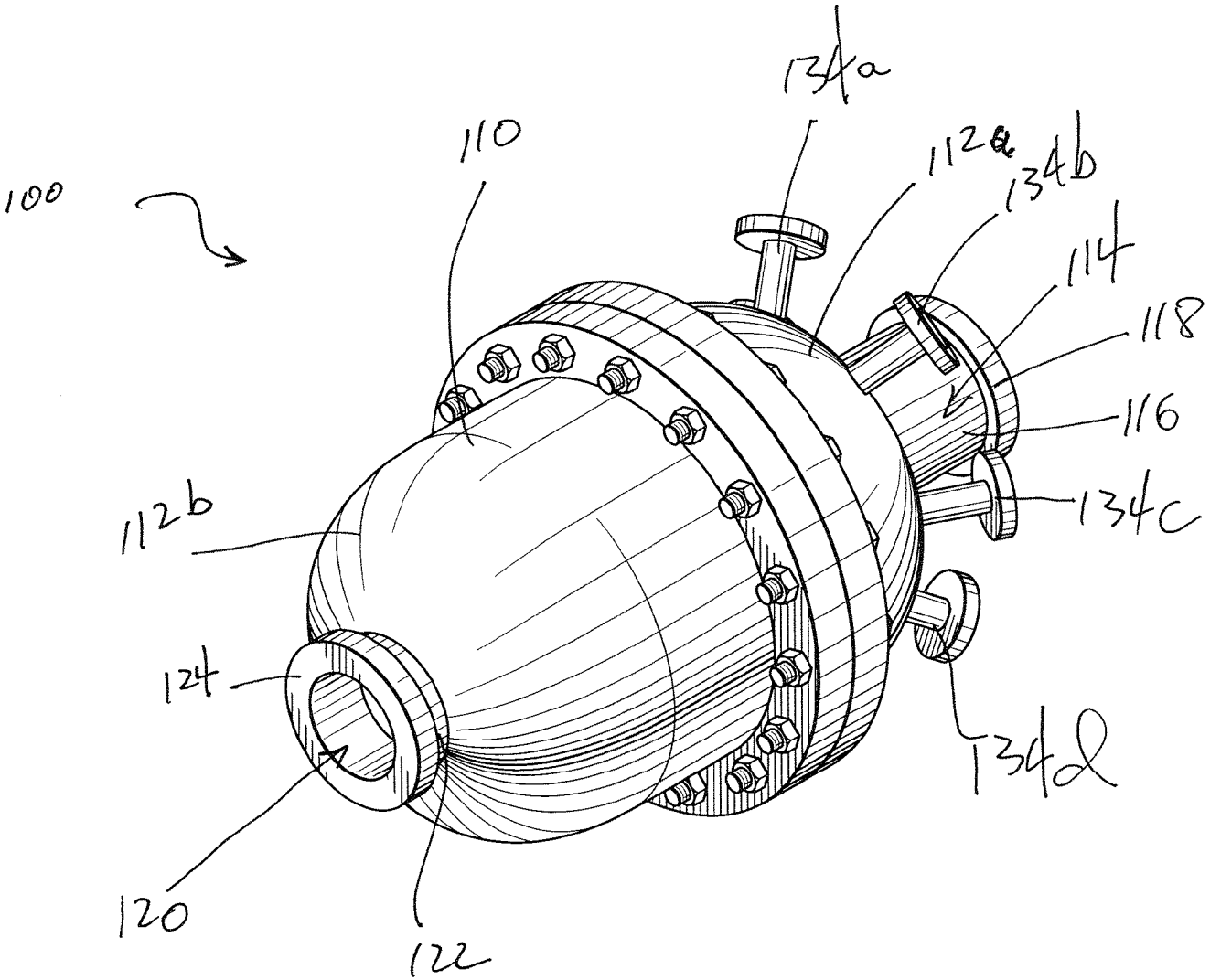
FIG. 8 is a perspective view of a further embodiment of an industrial heating system according to this invention.
Figure 9:
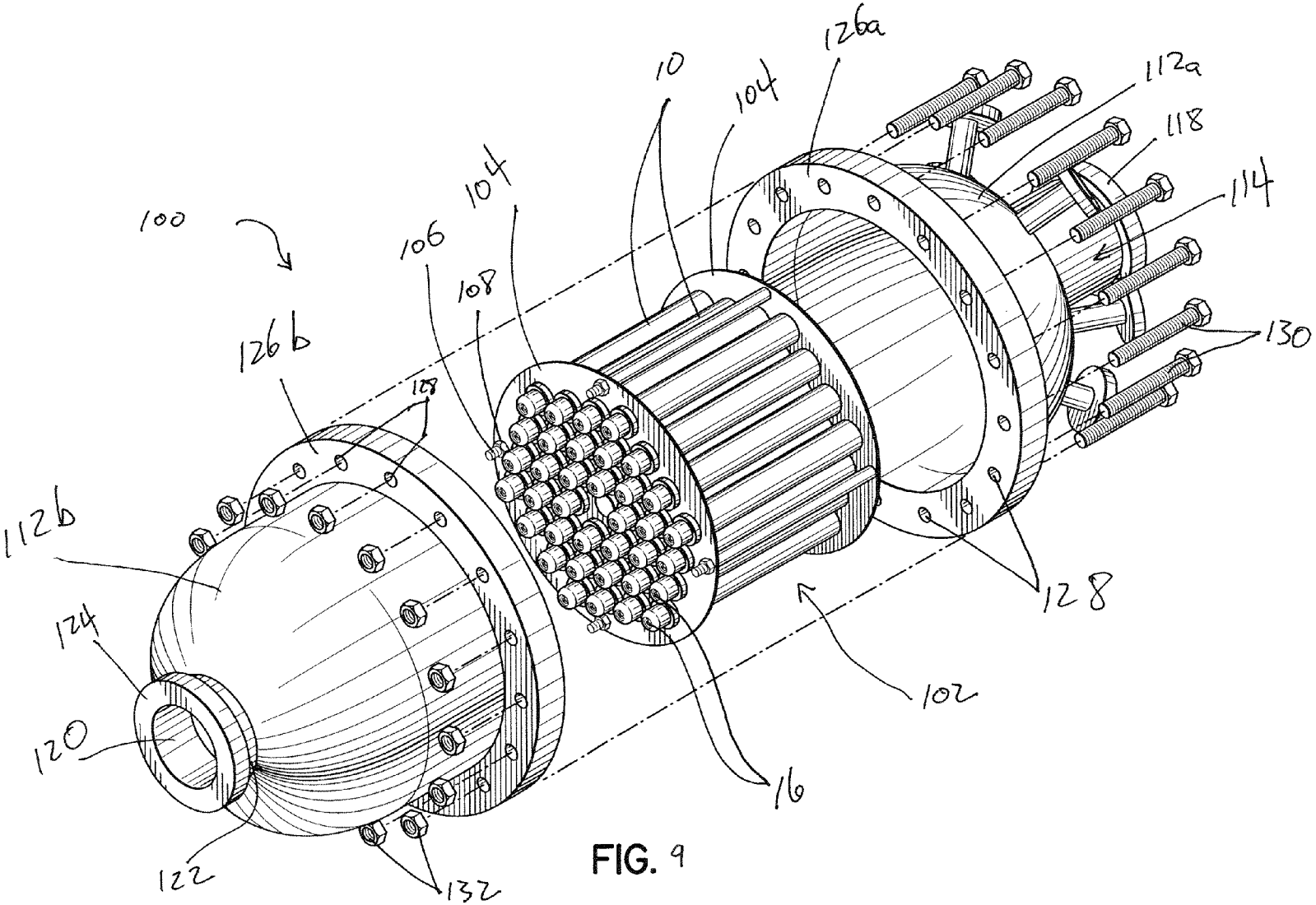
FIG. 9 is a partially disassembled perspective view of the system of FIG. 8.

An alternative embodiment of an industrial heating assembly 100 according to this invention is shown in FIGS. 8-9 with components of the heating assembly 100 that are the same or similar to corresponding components of the heater 10 being labeled in a similar manner. The heating assembly 100 according to this embodiment of the invention utilizes a heating cartridge 102 with multiple gas heaters 10 of the type disclosed in FIGS. 1-3 mounted in a generally parallel orientation relative to each other between a pair of generally circular spaced end plates 104. The end plates 104 are maintained in a spaced configuration by a series of spaced threaded rods or bolts 106 positioned around the periphery of the plates 104 and secured to the plates 104 by mechanical fasteners such as nuts 108 or the like. The cartridge 102 is shown in one configuration and those of ordinary skill in the art will readily appreciate that the number of gas heaters 10, their arrangement and configuration is available in a wide variety of different embodiments according to this invention.

The cartridge 102 is mounted within a sealed chamber 110 which is formed by a pair of mating dome-shaped enclosures 112*a*, 112*b*. The enclosure 112*a* proximate a gas entry port 114 of the heating assembly 100 includes a gas entry conduit 116 having a flange 118 adapted to mate with a gas feed supply (not shown). The enclosure 112*b* at a gas exit port 120 of the heating assembly 100 likewise includes a conduit 122 and compatible flange 124 for mating with downstream equipment to provide a sealed heating assembly 100.

Each of the dome-shaped enclosures 112*a*, 112*b* includes a peripheral flange 126*a*, 126*b* which is adapted to mate with the corresponding flange of the other enclosure 112*a*, 112*b* as shown in FIG. 9. The flanges 126*a*, 126*b* each include a number of through holes 128 which, when aligned with a corresponding through hole in the opposite flange, allow a threaded bolt 130 to pass there through so that a nut 132 can be threadaby mounted on the bolt 130 to secure the flanges 126*a*, 126*b* and dome-shaped enclosures 112*a*, 112*b* together to provide the sealed chamber 110. A gasket or other seal (not shown) may be provided and sandwiched between the flanges 126*a*, 126*b* as appropriate. The appropriate valves, gauges and instrumentation 134 may be mounted in communication with the interior of the chamber 110 for monitoring the gas heating therein. Various embodiments of the industrial gas heating assembly 100 shown in FIGS. 8-9 may be provided in 12 kW, 24 kW and 36 kW, 48 kW, 60 kW or other designs.

Figure 7:
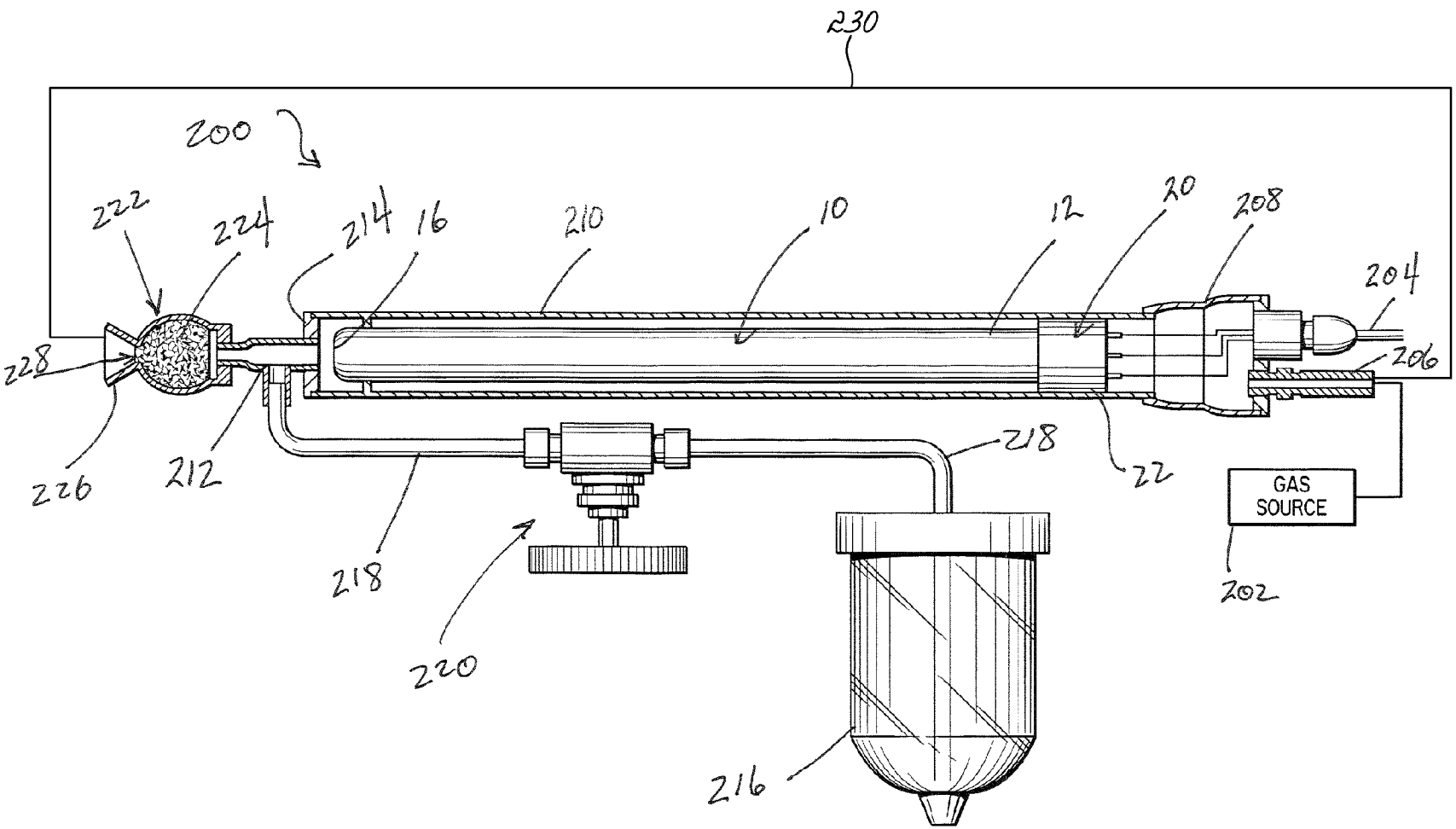
FIG. 7 is a perspective view of another embodiment of an industrial heating system according to this invention adapted to convert liquid to high temperature gas, e.g., generate supersaturated steam.

A further embodiment of an industrial heater 100 according to this invention is shown in FIG. 7 and is adapted to generate super heated steam. Traditionally, boiling water at high pressure and then heating the steam at high pressure have produced super heated steam. The embodiment of FIG. 7 provides a device where the flow of hot air over an orifice causes a super saturated steam jet. Components of the industrial heater and steam generator 200 shown in FIG. 7 that are the same or similar to corresponding components of the heater lo as shown in FIGS. 1-5 are labeled in a similar manner. The words "superheated", "supersaturated" and variations thereof are interchangeable. Superheated steam for the purposes of this specification is steam at less than 100° C. at 1 atmosphere or at high pressures greater than 1 atmosphere. It also encompasses $H_2O$ in the form of gas at any temperature. Although we use the word steam to illustrate making $H_2O$ gas or vapor we anticipate with this word any embodiment for the conversion of any fluid to a gaseous state with our apparatus and method. the word supersaturated steam is used to indicate $H_2O$ or other materials in the form of gas at temperatures above 100° C. at pressures of about 1 atmosphere (see FIG. 7) and/or higher (see FIG. 9). By supersaturated steam we also infer $H_2O$ in the form of vapor. One objective of this aspect of this invention is to make supersaturated steam at 1 atmosphere; whereas, it normally takes high pressure to make supersaturated steam. Although we use the word steam to illustrate making $H_2O$ gas or vapor we anticipate with this word any embodiment for the conversion of any fluid to a gaseous state with our apparatus and method. We also intend to use the words superheated and supersaturated interchangeably.

The heater and steam generator 200 includes a gas inlet source 202, which may be pressurized or unpressurized, and a power cord grip 204 proximate a gas inlet 206 of the device. A manifold housing 208 is mounted on the gas entry end of a casing 210 that is generally a right circular tube. An industrial gas heater lo according to a variety of embodiments according to this invention such as those shown in FIGS. 1-3 is mounted within the casing 210.

Proximate the gas exit port 16 of the industrial gas heater 10, a delivery tube 212 is mounted to an end plate 214 of the casing 210. The delivery tube 212 is in communication with a fluid reservoir or cup 216 which may be a polycarbonate reservoir. The delivery tube 212 advantageously includes a venturi assembly therein. A supply or feed line 218 from the reservoir 216 is regulated by a needle valve 220, the operation of which is well know by those of ordinary skill in the art. The valve 220 may be either mechanical, electromechanical, semiconductor, nano valve, needle valve, self regulation condition by water level or any other commonly understood regulating device with or without feedback. The feed line 218 is coupled to the delivery tube 212 as shown in FIG. 7. The supply feed line 218 may be stainless steel piping or other appropriate material. The delivery tube 212 feeds into a reactor vessel 222 having a generally bulbous configuration. Contained within the reactor vessel 222 is a porous medium 224 such as steel wool or other generally non-dissolvable media; however, a dissolvable media may be utilized within the reactor vessel 222, if appropriate. The porous medium 224 may be made of metallic, ceramic, polymer, intermetallic, nano-materials, or composite materials or combinations and mixtures thereof. The porosity may be reticulated or well defined. The porosity may be even or uneven and may vary from nanometer-size to centimeter sized pores. An exit nozzle 226 is provided on the reactor vessel 222 and may include a diffuser 228.

The liquid to be heated into super saturated steam is contained within the reservoir 216 and fed to the venturi tube through the inlet pipe as regulated by the needle valve. The gas heated by the gas heater passes into the delivery or venturi tube 212 that is connected to the liquid reservoir 216. As the hot gas passes through the venturi tube 212, it draws the liquid from the reservoir 216. The liquid flow as previously stated is controlled by the needle valve 220. The liquid is atomized in the venturi tube 212 and the liquid/gas mixture enters the reactor vessel 222 where the liquid is vaporized. The unique design of the reactor vessel 222 provides for total vaporization of the liquid. The vaporized fluid exiting the reactor vessel 222 may be re-circulated through the system 200 and introduced into the gas inlet 202. For example, this may be achieved through a recirculation loop 230. Furthermore, the apparatus and method of this invention may produce steam by the addition of $H_2O$ through one or both of the coils in the gas heater 10. This introduction of the $H_2O$ may be at the inlet, outlet or in-between the gas passage and the $H_2O$ may be added in the form of a liquid, gas or mist.

We have noted that the position of the valve 220 influences the air steam mixture. For example, at 100 ml of water in 462 seconds, a high 40% specific humidity value at 375° C. at about 1.3 cfm of hot air is generated. The relative humidity is estimated to be about 40% at this temperature assuming full compositional scale ideal gas mixing with no mixing enthalpy. Further, at 375° C., a pressure of 22 MPa (i.e., approximately 220 times atmospheric pressure) is needed to initiate condensation of the mixture. Alternatively, cooling the gas to about 110° C. at one atmosphere is required to initiate condensation. Specific humidity is defined as the mass of $H_2O$ divided by the mass of air.

Steam temperature depends on the water valve 220 setting and air inflow setting. Typical settings at a full power of 1 kW for the gas heater 1o are as follows: gas at 1.45 CFM and water at 200 ml in 45 minutes yields steam air temperature of approximately 350° C. Gas at 1.4 CFM and water at 200 ml in 20 minutes yields steam air temperature of about 250° C. Further, gas at 1.8 CFM and water at 200 ml in 20 minutes yields steam air temperature of about 150° C. The above examples utilize a gas inlet temperature at approximately 30° C. and the water inlet temperature at approximately 30° C.

Possible applications for the industrial heating assembly and steam super saturated generator 200 of FIG. 7 include high temperature super-heated steam-air or steam-gas generation. This could be utilized for layering, epoxy drying and other film uses where super-heated steam is required at one atmospheric pressure. Applications for formica polymeric materials, drying, degreasing, wood conditioners etc. are contemplated. This application is ideal for steam drying or steam oxidation as well as for spray deposition and spray cooling. Nano-crystal and larger crystal-sized production is possible by dissolving, gasification (i.e., steaming) and precipitation on cooling the gas. Silicon purification may be possible also for use in thermo-electrics and solar cell applications. Other applications for the system of FIG. 7 include fogging, gas moisturizing, hot coating, steam generation, vapor deposition, cooking, rice making, cleaning, drying and epoxy hardening. Applications in energy devices such as fuel cells are anticipated.

Figure 11:
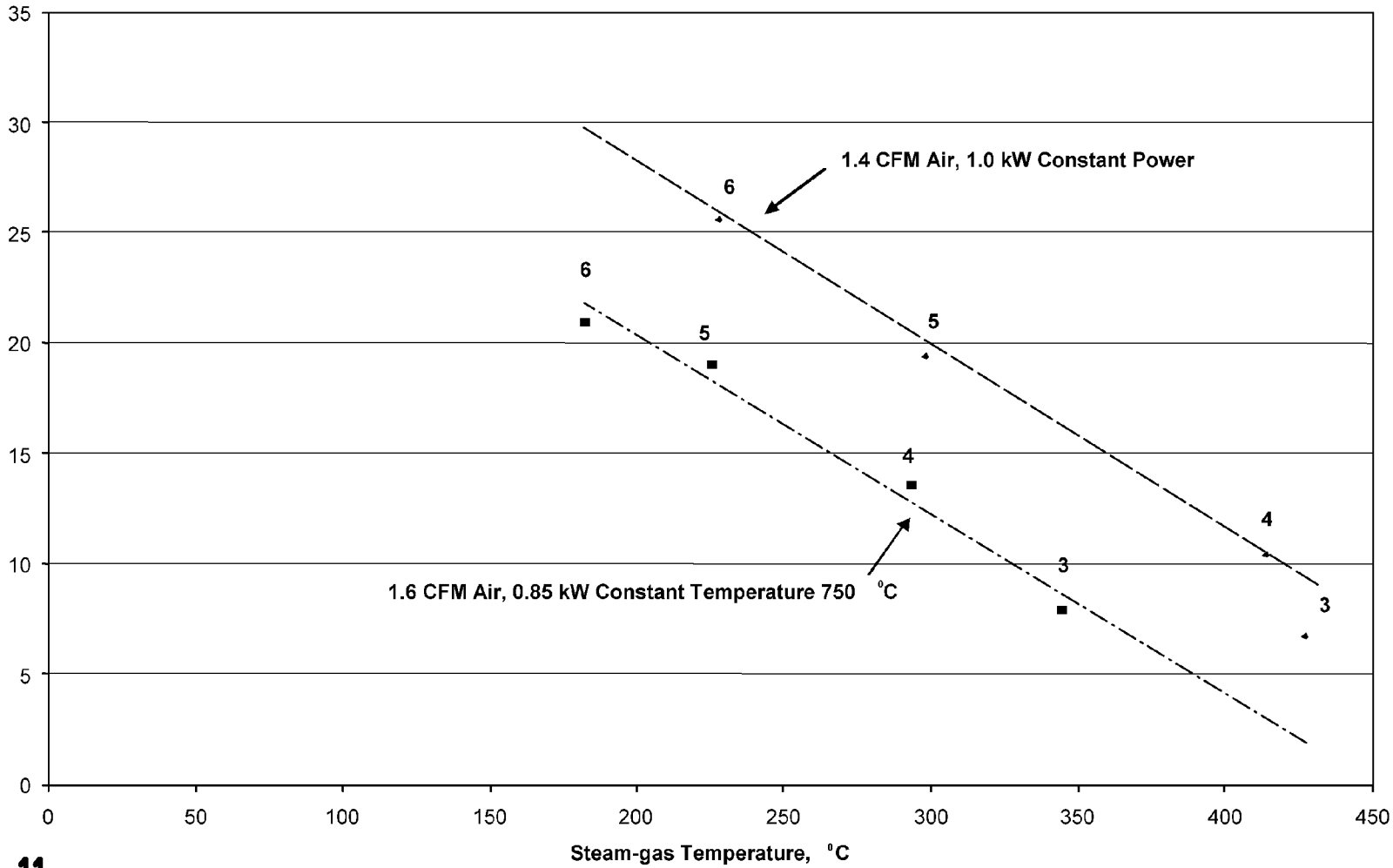
FIG. 11 is a graphical illustration of how to adjust the system of FIG. 7 for different levels of specific humidity.

The graph shown in FIG. 11 provides exemplary data of how to adjust the system 200 of FIG. 7 for different levels of specific humidity. Note as the specific humidity increases, there is a corresponding decrease in overall temperature as total energy is conserved. For the graph in FIG. 11, the steam gas thermocouple is positioned at the gas exit port. Variations of the data shown in the graph of FIG. 11 may be expected to be varied upon replacement of the thermocouple, restrictions on gas and water flow and other random errors normally present in multi-variant measurements. As one of ordinary skill in the art will appreciate, specific applications would require optimization of all valve settings for optimum results. Standard water steam temperature, pressure diagrams and saturated steam and super-heated steam pressure and temperature tables may be utilized for such optimization.

Various embodiments of the heaters 10, 100, 200 according to this invention were tested and the results are summarized and presented herein. The following tests were done with (1) metallic wire and (2) with molybdenum disilicide wire and the following results were obtained.

Metallic Wire. Commonly available metallic heating wire 28*a*, 30*a* made of Nickel Chromium alloy or Fe—Al—Cr or Fe—Al, Ni—Cr alloy was used. Generally, such metallic wires can be heated in air to about 1200° C. Wire diameters from 0.1 mm to a 1.2 mm were tried for the experiments. We conducted the following experiments with the Fe—Al—Cr alloy. Alloys made of Fe—Al—Cr—Nb or Fe—Al—Cr—Mo—Nb were expected to perform similarly as are other metallic & intermetallic systems.

In one experiment, the gas was heated to 850° C. at a 3.5 scfm (standard cubic feet per minute, standard conditions are normally 25° C. and 1.0 astrosphere) flow rate with the following design features of the heater. Other experiments were also conducted where gas was heated to close to 1000° C. The experiment utilized a wire coil with a wire diameter of 1.2 mm for the inner and outer coils 28, 30. The outer coil wire 30*a* separation (pitch) was 0.285 mm and the inner coil wire 28*a* separation (pitch) was 0.285 mm. The wires 28*a*, 30*a* of the inner and outer coils 28, 30 were wound in opposite directions. A thermocouple 38 was located at about 3 mm from the gas exit port 16. When located at this location, the thermocouple read up to 980° C. It is expected that the upper range with metallic elements will be about 1000° C. for ambient air. Other gases, depending on their thermal properties, will have a different exit temperature. Metallic elements made of Mo, W or other such higher temperature metals provide higher gas exit temperatures up to 3000° C.

We contemplate that the wire sizes for the inner and outer coils 28, 30 could be different for different industrial applications. Similarly the pitch can be different for each coil 28, 30 and different at different locations in the same coil according to this invention. For example, the coil pitch proximate to the incoming power leads 28*d*, 30*d* could be larger than at the main heating sections of the coils 28, 30 to keep the contacts relatively cooler. Spacers and other inserts between the coils 28, 30 are contemplated, if required, according to this invention.

It is thought that the presence of the inner coil 28 serves to overcome the surface or conda effect and thus improves contact with the gas flowing through the tubular housing 12.

Some further experiments were conducted. Coil design was adjusted with the appropriate physics in mind.

Experiment 1: The outer coil 30 provides rifling of the gas that increases heat transfer from the coil to the gas. A helical coil wire 30*a* of 240 mm long and 13.2 mm mean diameter, working out for 8.2 Ohms (18 SWG A1 commercial wire) was used for testing. The coil was inserted in an open-ended ceramic tube 12. The exit end of the coil was brought back to the inlet side through a ceramic insulating tube. The coil was operated at 110V, at a power rating of 1.47 kW. The airflow was maintained at 5 SCFM@ 0.4 Kgs/cm$^2$ working pressure. The exit temperature of the air stabilized at 560° C.

Experiment 2: The inner coil 28 over comes the conda surface effect, and provides for annular area heating of the gas, which provides for the highest heat transfer to the gas. The exit end of the coil 28 was wound on its return on the ceramic insulating tubular housing 12. The resulting coil resistance was 10.8 Ohms. The coil 28 was operated with the same airflow, air pressure and operating voltage of 110V as in Experiment 1. The coil now operated at 1.1 kW, and the exit temperature stabilized at 806° C.

Experiment 3: The inner coil 28 was wound in the opposite direction of the outer coil 30 to provide opposite rifling to the gas with respect to the outer coil. This causes a turbulence effect on the airflow, which increases heat transfer to the gas. All other parameters were the same as Experiment 2. The exit temperature stabilized at 845° C. Therefore, the opposite winding configuration gave a nearly 50° C. higher temperature. Table 1 below gives further experimental details and exit temperatures.

Experiment 4: An experiment was conducted with an inner coiled-coil 28 and an outer coiled-coil 30 (FIG. 10). The gap was between 6 to 10 mm (i.e. the outer diameter (OD) of the inner coiled-coil, was 40 mm and the inner diameter (ID) of the outer coiled-coil was about 60 mm). The wire 28*a*, 30*a* itself was 0.8 mm in diameter and the diameter of the coiled-coil was about 8 mm. The material of the wire was Fe—Cr—Al alloy. At about 1.6 SCFM we found a temperature of 650° C. was reached in a few minutes at the exit for air. When water was introduced as a mist, at the inlet point a final steam gas temperature of 230° C. was obtained.

Experiment 5: Several modules as described in Experiments 3 and 4 were arranged in parallel and superheated steam was generated both by mist injection before the coil and ahead of the coil. This air-supersaturated steam was continuously recirculated through the assembly in order to increase the $H_2O$ content in the gas. Experiments are continuing in order to get more quantitative readings of the specific humidity. The modules and method of heating were found to be suitable for recirculation.

TABLE 1

| Experiment Number | Coil resistance (Ohms) | Voltage (Volts) | Current (Amps) | Airflow cross section area (mm2) | Power (kW) | Air Flow (SCFM) | Air Pressure (Kg/cm$^2$) | Exit temperature of air (° C.) |
|---|---|---|---|---|---|---|---|---|
| Experiment 1 | 8.2 | 110 | 13.4 | 25.1 | 1.47 | 5 | 7 | 560 |
| Experiment 2 | 10.8 | 110 | 10 | 17.2 | 1.1 | 5 | 7 | 806 |
| Experiment 3 | 10.8 | 110 | 10 | 17.2 | 1.1 | 5 | 7 | 845 |
| Experiment 4 | 11.0 | 110 | 10 | 55.2 | 1.1 | 3.5 | 0.4 | 850 |

TABLE 2

Typical Results of the Present Invention
UAT5 Ref: p83(4) HIPAN Primary: 208 Volts, Secondary: 40 Volts tap.

| | Temperature, C. | | Flow, | Secondary | | Primary | | |
|---|---|---|---|---|---|---|---|---|
| Time | Set point | Process | SCFM | Current | Volts | Current | Volts | Comments |
| 10:00 | 0 | RT | 2.0 | 0 | 0 | 0 | 0 | Started |
| 10:03 | 1400 | 542 | 2.0 | 93 | 14 | 16 | | |
| 10:05 | 1400 | 1167 | 2.0 | 103 | 21 | 18 | | |
| 10:07 | 1400 | 1371 | 2.0 | 95 | 21 | 18 | | |
| 10:08 | 1400 | 1400 | 2.0 | 106 | 18 | 15 | | |
| 10:20 | 1400 | 1402 | 2.0 | 105 | 18 | 18 | | |
| 10:30 | 1400 | 1400 | 2.0 | 79 | 16 | 14 | | |
| 10:38 | 1400 | 1400 | 2.0 | 77 | 16 | 13 | | |
| 10:38:50 | 1400 | 1400 | 3.0 | 86 | 18 | 14 | | |
| 10:48 | 1400 | 1400 | 3.0 | 86 | 17 | 14 | | |
| 10:58 | 1400 | 1400 | 3.0 | 81 | 16 | 14 | | |
| 11:08 | 1400 | 1400 | 3.0 | 81 | 16 | 15 | | |
| 11:08:50 | 1400 | 1400 | 4.0 | 89 | 18 | 16 | 81 | |
| 11:20 | 1400 | 1400 | 4.0 | 96 | 19 | 17 | | End |

RT: Room temperature

TABLE 3

Typical Results of the Present Invention
UAT5 Ref: p95(4) HIPAN Primary: 240 Volts, Secondary: 40 Volts tap.

| | Temperature, C. | | | Flow, | Secondary | | Primary | | |
|---|---|---|---|---|---|---|---|---|---|
| Time | Set point | Process | In-situ | SCFM | Current | Volts | Current | Volts | Comments |
| 9:35 | 0 | RT | RT | 3.0 | 0 | 0 | 0 | 0 | Started |
| 9:39 | 1050 | 1046 | 621 | 3.0 | 89 | 13 | 15 | | |
| 9:42 | 1372 | 1334 | 942 | 3.0 | 102 | 19.6 | 18 | | |
| 9:43 | 1372 | 1372 | 1032 | 3.0 | 95 | 18.5 | 17 | | |
| 9:47 | 1372 | 1372 | 1055 | 3.0 | 123 | 22 | 19 | | End |

TABLE 3-continued

Typical Results of the Present Invention
UAT5 Ref: p95(4) HIPAN Primary: 240 Volts, Secondary: 40 Volts tap.

| | Temperature, C. | | | | | | | | |
|---|---|---|---|---|---|---|---|---|---|
| | Set | | | Flow, | Secondary | | Primary | | |
| Time | point | Process | In-situ | SCFM | Current | Volts | Current | Volts | Comments |
| 10:47 | 1400 | 392 | 432 | 3.0 | 0 | 0 | 0 | 0 | Re-started |
| 10:49 | 1400 | 1042 | 702 | 3.0 | 124 | 19.7 | 22 | | |
| 10:50 | 1400 | 1375 | 954 | 3.0 | 98 | 18.8 | 17 | | |
| 10:51 | 1400 | 1397 | 1022 | 3.0 | 95 | | 16 | | |
| 10:52 | 1400 | 1400 | 1074 | 3.0 | 89 | 17 | 16 | | |
| 11:00 | 1400 | 1400 | 1165 | 3.0 | 81 | | 15 | | |
| 11:10 | 1500 | 1500 | 1279 | 1.0 | 70 | | 12 | | |
| 11:13 | 1500 | 1500 | 1301 | 1.0 | 67 | 14 | 12 | 81 | |
| 11:18 | 1500 | 1500 | 1314 | 1.0 | 66 | 12 | 12 | | |
| 11:26 | 1500 | 1500 | 1316 | 0.5 | 56 | 11 | 10 | | |
| 11:28 | 1500 | 1500 | 1315 | 1.0 | 60 | 12 | 10 | | |
| 11:39 | 1500 | 1500 | 1316 | 1.0 | 58 | 11 | 10 | 88 | |
| 11:53 | 1500 | 1500 | 1322 | 1.0 | 57 | 11 | 10 | 69 | |
| 12:05 | 1500 | 1500 | 1322 | 1.0 | 56 | 11 | 10 | 69 | |
| 12:55 | 1500 | 1500 | 1324 | 1.0 | 55 | 11 | 10 | | |
| 1:31 | 1500 | 1500 | 1324 | 1.0 | 55 | 11 | 10 | | |
| 2:05 | 1500 | 1500 | 1328 | 1.0 | 55 | 11 | 10 | | |
| 3:30 | 1500 | 1500 | 1332 | 1.0 | 55 | 11 | 10 | | |
| 5:00 | 1500 | 1500 | 1332 | 1.0 | 55 | 11 | 10 | 70 | End |

It is contemplated that molybdenum disilicide wires 28*a*, 30*a* can be heated in air to 1900° C. for this invention. However, such wires are more brittle than metallic wire. The molybdenum disilicide coils were obtained from Micropyretics Heaters International, Inc. of Cincinnati, Ohio (www-.MHI-INC.COM).

Wire 28*a* 30*a* diameters of 3 mm, 4 mm or 5 mm may be used with this invention. An experiment was conducted with outer coil wire 30*a* separation (pitch) at 12.7 mm and inner coil wire 28*a* separation (pitch) at 12.7 mm. The gap between the coils 28, 30 tested was varied from 4 mm to 15 mm. Best results were obtained with the 5 mm wire.

The best test results of Table 2 show a temperature of 1165° C. to 1400° C. at different measurement positions with 1400° C. as set point on the controller and airflow set to 1 scfm.

The best test results of Table 3 show a temperature of 1332° C. to 1500° C. at different measurement positions with 1500° C. as set point on the controller and airflow set to 1 scfm. In an experiment with the inner coil 28 at about 40 mm and the outer coil at about 65 mm, a wire thickness of about 0.8 mm and coil of about 1 mm diameter Fe—Cr—Al alloy, barely separated for the coiled wire embodiment, the exit temperature with air was 650° C. with a flow rate of about 1.6 scfm (estimated approximate). The pitch separation of the coils may be smaller for metallic coil materials and larger for ceramic materials. We were also able to introduce a water mist into these coil arrangements and obtain a high quality steam output (see FIG. 7).

As a result of this invention, as yet unavailable very high temperatures in gases for industrial applications are obtainable because of the new coil in coil design with the proper spacing and gaps with the two coils 28, 30 electrically coupled. It is also found that opposite winding in the inner and outer coils 28, 30 gives rise to very high temperatures of the gas at the exit port 16.

The typical industrial applications for this invention involve low cost heating. Three different types of industrial applications are considered without limiting the invention from other industrial applications:

1. Heating of any gas, including steam, directed into chamber such as an oven or furnace that may or may not have other heating systems in it.

2. Heating of any gas, including steam, passing though the coils.

3. Heating any gas, including steam, directed at a surface for applications such as coatings, hardening, debinding, glowing, etc.

The coils 28, 30 may be electrically heated or heated by a combination of electric and other thermal methods. The coils 28, 30 can be metallic, molybdenum disilicide, silicon carbide, intermetallic, ceramic or other materials.

From the above disclosure of the general principles of the present invention and the preceding detailed description of various embodiments, those skilled in the art will readily comprehend the various modifications to which this invention is susceptible. Therefore, we desire to be limited only by the scope of the following claims and equivalents thereof.

We claim:

1. An industrial gas heater comprising:

a tubular enclosure having a gas entry port spaced from a gas exit port;

an inner helical coil contained within the tubular enclosure; and an outer helical coil contained within the tubular enclosure and surrounding the inner coil to define a substantially unobstructed annular space between the coils;

wherein the inner and outer coils together form a generally continuous wire, are bare, and electrically coupled to heat a gas entering the tubular enclosure gas entry port, passing through the annular space and exiting the tubular enclosure via the gas exit port.

2. The industrial gas heater of claim 1 wherein the inner and outer coils are each right circular helical coils and are arranged concentrically.

3. The industrial gas heater of claim 1 wherein the inner and outer coils are wound in opposite directions from each other.

4. The industrial gas heater of claim 2 wherein a radial dimension of the annular space ranges from about 1.5 mm to about 20 mm.

5. The industrial gas heater of claim 1 wherein each coil further comprises:

a generally continuous wire concentrically wound into a right circular helical coil and a diameter of the wire ranges from about 0.1 mm to about 6 mm.

6. The industrial gas heater of claim 1 wherein a cross-sectional area of the annular space ranges from about 15 $mm^2$ to about 6000 $mm^2$.

7. The industrial gas heater of claim 1 wherein the inner and outer coils have different configurations from each other.

8. The industrial gas heater of claim 1 wherein a gap between adjacent turns of the respective inner and outer coils ranges from about 0.01 mm to about 85 mm.

9. The industrial gas heater of claim 1 further comprising:

a spacer positioned within the tubular enclosure, proximate the gas exit port and adjacent distal ends of the inner and outer coils.

10. The industrial gas heater of claim 9 wherein the spacer further comprises a plurality of radial projecting, spaced vanes.

11. The industrial gas heater of claim 1 wherein the tubular enclosure further comprises:

a right circular cylindrical housing having an open end proximate the gas entry port; and an end cap closing the open end of the housing.

12. The industrial gas heater of claim 1 wherein the outer coil is positioned in close proximity to an inner surface of the tubular enclosure to minimize gas flow between the outer coil and the inner surface of the tubular enclosure.

13. The industrial gas heater of claim 1 wherein the inner and outer coils are adapted to heat the gas flowing through the annular space and exiting the gas exit port to a temperature in the range of about 500° C. to about 1500° C. and at a rate in the range of about 1 cfm to about 1000 cfm.

14. The industrial gas heater of claim 1 wherein at least one of the inner and outer coils is formed from a coil wire.

15. The industrial gas heater of claim 1 further comprising:

a steam generator operatively coupled to the gas heater proximate the gas exit port.

16. The industrial gas heater of claim 15 wherein the steam generator is operatively coupled to the gas entry port to provide for recirculation of the steam exiting from the steam generator.

17. The industrial gas heater of claim 15 wherein the steam generator further comprises:

a fluid reservoir;

one of a venturi assembly and a mist assembly; and a reactor vessel, wherein the fluid reservoir is operatively coupled to either the venturi assembly or the mist assembly to mix fluid from the reservoir with the heated gas to be fed into the reactor vessel.

18. An industrial gas heater comprising:

a right circular cylindrical tubular housing having an open end proximate a gas entry port and spaced from a gas exit port;

an inner right circular helical coil contained within the tubular enclosure;

an outer right circular helical coil contained within the tubular housing and concentrically surrounding the inner coil to define a substantially unobstructed annular space between the coils;

wherein the inner and outer coils together form a generally continuous wire, are bare, and wound in opposite directions from each other;

wherein each coil is electrically coupled to heat a gas entering the tubular housing gas entry port, passing through the annular space and exiting the tubular housing via the gas exit port;

a spacer positioned within the tubular enclosure, proximate the gas exit port and adjacent distal ends of the inner and outer coils; and an end cap at the open end of the housing.

19. The industrial gas heater of claim 18 wherein a radial dimension of the annular space ranges from about 1.5 mm to about 20 mm and a cross-sectional area of the annular space ranges from about 15 $mm^2$ to about 6000 $mm^2$.

20. The industrial gas heater of claim 18 wherein each coil further comprises:

a generally continuous wire concentrically wound into a right circular helical coil and a diameter of the wire ranges from about 0.1 mm to about 6 mm and a pitch gap between adjacent turns of the respective inner and outer coils ranges from about 0.1 mm to about 65 mm.

21. The industrial gas heater of claim 20 wherein each wire is in the shape of a coil.

22. The industrial gas heater of claim 18 wherein the outer coil is positioned in close proximity to an inner surface of the tubular housing to minimize gas flow between the outer coil and the inner surface of the tubular enclosure.

23. The industrial gas heater of claim 18 wherein the inner and outer coils are adapted to heat the gas flowing through the annular space and exiting the gas exit port to a temperature in the range of about 500° C. to about 1500° C. and at a rate in the range of about 1 cfm to about 1000 cfm.

24. A method of heating a gas for industrial applications comprising the steps of:

introducing the gas into a tubular enclosure through an entry port of the tubular enclosure;

flowing the gas through a substantially unobstructed annular space within the tubular enclosure and between bare inner and outer helical coils, the outer helical coil surrounding the inner helical coil so that the annular space extends between the inner and outer coils;

electrically heating the inner and outer coils formed together from a generally continuous wire, and expelling the gas out of the tubular enclosure through an exit port in the tubular enclosure spaced from the entry port at a temperature in the range of about 500° C. to about 1500° C. and at a rate in the range of about 1 cfm to about 1000 cfm.

25. The method of claim 24 further comprising:

spiraling the gas between adjacent turns of the inner and the outer coils.

26. The method of claim 25 wherein the spiraling step further comprises:

spiraling the gas between the adjacent turns of the inner coil in a first direction; and spiraling the gas between the adjacent turns of the outer coil in a second direction opposite from the first direction.

27. The method of claim 24 further comprising:

introducing water to thereby generate steam.

28. An industrial gas heating assembly comprising:

a sealed chamber having a gas inlet and a gas outlet;

a gas heating cartridge contained within the sealed chamber, the gas heating cartridge having a plurality of gas heaters mounted in a fixed relationship relative to each other for heating the gas flowing from the gas inlet to the gas outlet, each gas heater further comprising:

(a) a tubular enclosure having a gas entry port spaced from a gas exit port;

(b) an inner helical coil contained within the tubular enclosure; and (c) an outer helical coil contained within the tubular enclosure and surrounding the inner coil to define a substantially unobstructed annular space between the coils;

wherein the inner and outer coils together form a generally continuous wire, are bare, and electrically coupled to heat a gas entering the tubular enclosure gas entry port, passing through the annular space and exiting the tubular enclosure via the gas exit port.

29. The industrial gas heating assembly of claim 27 wherein the sealed chamber further comprises:

a first and a second dome-shaped enclosure mated together having the gas inlet and gas outlet, respectively.

30. The industrial gas heating assembly of claim 28 wherein the gas heating cartridge further comprises:

a pair of spaced plates with each of the plurality of gas heaters similarly oriented and mounted to the plates in an orientation generally aligned with a longitudinal axis of the chamber extending between the gas inlet and the gas outlet.

* * * * *